US006421024B1

(12) United States Patent
Stolle

(10) Patent No.: US 6,421,024 B1
(45) Date of Patent: Jul. 16, 2002

(54) MULTI-FREQUENCY BAND ANTENNA

(75) Inventor: Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 09/743,092

(22) PCT Filed: May 4, 2000

(86) PCT No.: PCT/EP00/03999

§ 371 (c)(1),
(2), (4) Date: Jan. 5, 2001

(87) PCT Pub. No.: WO00/69018

PCT Pub. Date: Nov. 16, 2000

(30) Foreign Application Priority Data

May 6, 1999 (DE) ..... 199 20 980
May 6, 1999 (DE) ..... 199 20 978

(51) Int. Cl.[7] ..... H01Q 9/16; H01Q 9/04
(52) U.S. Cl. ..... 343/792; 343/790; 343/793
(58) Field of Search ..... 343/790, 791, 343/792, 702, 793

(56) References Cited

U.S. PATENT DOCUMENTS

| | | | | |
|---|---|---|---|---|
| 3,022,507 A | | 2/1962 | Boyer | 343/818 |
| 4,125,840 A | | 11/1978 | Cassel | 343/801 |
| 5,248,988 A | * | 9/1993 | Makino | 343/792 |
| 5,440,317 A | * | 8/1995 | Jalloul et al. | 343/791 |
| 5,521,608 A | | 5/1996 | Brandt et al. | 343/749 |
| 5,604,506 A | * | 2/1997 | Rodal | 343/791 |
| 6,037,907 A | * | 3/2000 | Ha et al. | 343/792 |

FOREIGN PATENT DOCUMENTS

| | | | |
|---|---|---|---|
| EP | 0 411 363 | 2/1991 | H01Q/9/16 |

OTHER PUBLICATIONS

Libby Lester L.: "Wide–Range Dual–Band TV Antenna Design" Communications (Jun. 1948), pp. 12–31.

Patent Abstracts of Japan vol. 012, No. 447 E–685 (Nov. 1988) & JP 63–174412 (Matsushita Electric Works Ltd), (Jul. 1988).

Patent Abstracts of Japan vol. 4, No. 181E–37 (Dec. 1980) & JP 55–123203.

Patent Abstracts of Japan (Apr. 1995) & 07106840.

* cited by examiner

*Primary Examiner*—Don Wong
*Assistant Examiner*—Hoang Nguyen
(74) *Attorney, Agent, or Firm*—Nixon & Vanderhye P.C.

(57) ABSTRACT

A multiband antenna has a first antenna device for a first frequency band range and at least one second antenna device for a second frequency band range. The first antenna and the at least second antenna are arranged such that they are integrated and interleaved in one another. The associated dipole halves of the antennas are designed to be at least electrically in the form of, or similar to, sleeves or boxes. The dipole halves of the at least two antennas are short-circuited to one another at their respective mutually adjacent end, and extend from there with different lengths depending on the frequency band range to be transmitted. The dipole halves for transmitting the respectively lower frequency band range are located within the dipole halves which are intended for transmitting a respectively higher frequency or a respectively higher frequency band range.

41 Claims, 6 Drawing Sheets

MULTI-FREQUENCY BAND ANTENNA

Figure 1A:
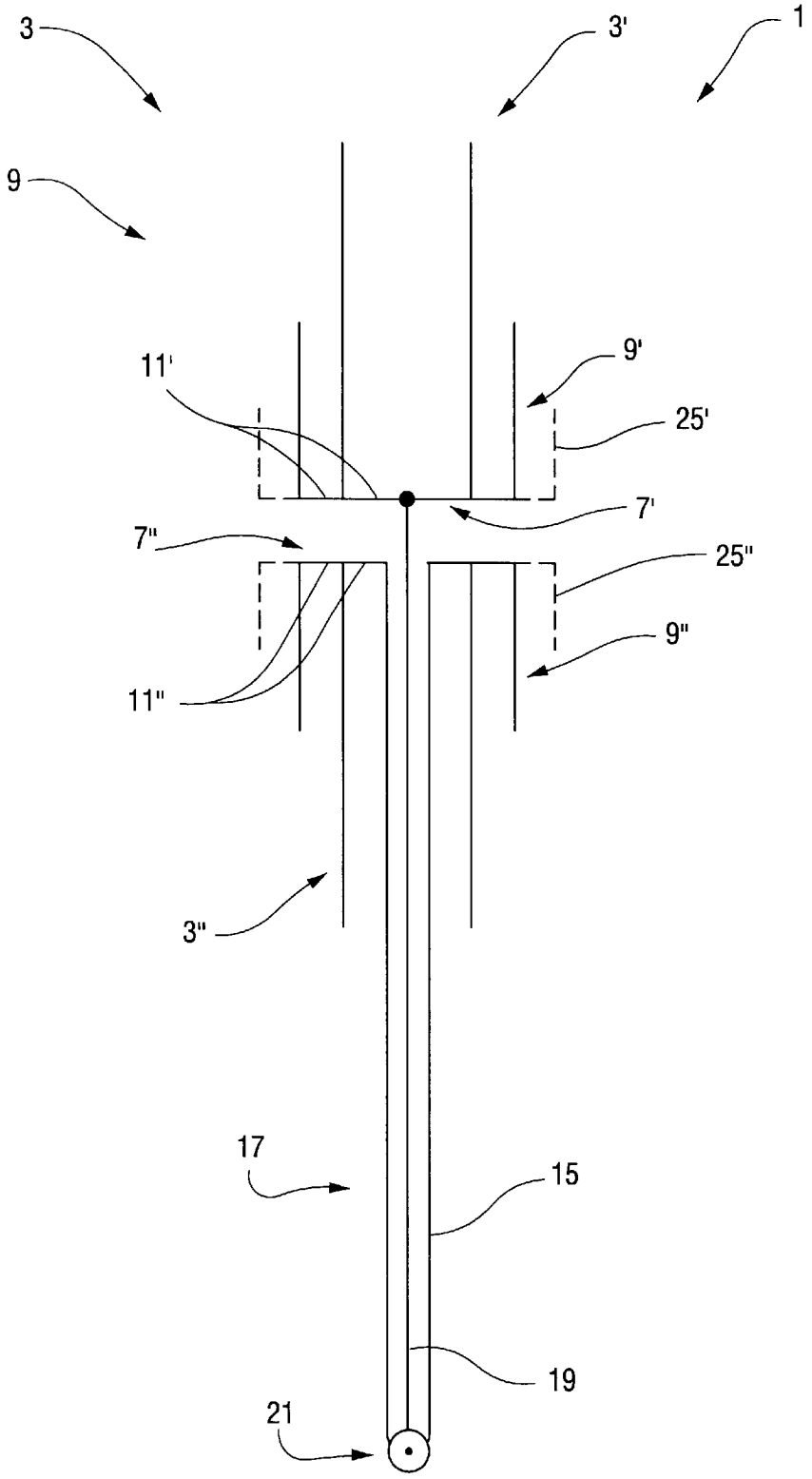

The invention relates to a multiband antenna.

Most mobile communication is handled via the GSM 900 network, that is to say in the 900 MHz band. In addition, the GSM 1800 Standard has been established, inter alia, in Europe, in which Standard signals can be transmitted and received in an 1800 MHz band.

Such multiband base stations therefore require multiband antenna devices for transmitting and receiving different frequency bands, which normally have dipole structures, that is to say a dipole antenna device for transmitting and receiving the 900 MHz band range and a further dipole antenna device for transmitting and receiving the 1800 MHz band range.

In practice, therefore, multiband, or at least two-band, antenna devices have already been proposed, namely, for example, a dipole antenna device for transmitting the 900 MHz band and for transmitting the 1800 MHz band, with the two dipole antenna devices being arranged alongside one another. Two antennas are therefore required in each case for the at least two frequency band ranges which, in fact, since they are arranged physically alongside one another, interfere with one another and have an adverse effect on one another, since they shadow each other's polar diagram. It is thus no longer possible to achieve an omnidirectional polar diagram.

It has therefore also already been proposed for two corresponding antenna devices to be arranged one above the other for operation in two different frequency band ranges. This, of course, leads to a greater physical height and demands a larger amount of space. In addition, the omnidirectional polar diagram is in some circumstances also adversely affected, at least to a minor extent, since the connecting line leading to the higher antenna device has to be routed past the lower antenna device.

The object of the present invention, in contrast, is to provide an improved two-band or multiband antenna device.

According to the invention, this object is achieved by the features specified in claim 1. Advantageous refinements of the invention are specified in the dependent claims.

In comparison to the prior art, the present invention provides, in a surprising manner, a completely novel, extremely compact antenna device which can be operated in a two frequency band range. However, if required, this antenna device can also be extended as required for a multiband range covering more than two frequency bands.

Specifically, the invention provides for the dipole antenna device for the first frequency band and the dipole device for the at least second frequency band, which is offset from the former, to be formed coaxially with respect to one another and in the process, such that they are located interleaved in one another.

To this end, according to the invention, the dipole halves are preferably in the form of sleeves, with the sleeve diameters of the dipole halves differing from one another to such an extent that the sleeves are arranged one inside the other. The length of the dipole halves in this case depends on the frequency band range to be transmitted. Those dipole halves which are in the form of sleeves, are designed to have the shorter length and are required for the higher frequency band range are in this case located on the outside, with those dipole halves which are designed to be appropriately longer for the lower frequency band range being arranged inside these outer sleeves, with their length projecting beyond the outer dipole sleeves.

The outer and inner sleeves of the dipole halves are each electrically and mechanically connected at their inner ends to a short-circuiting point which is similar to a sleeve base, with the one dipole halves, which are interleaved in one another in the form of sleeves, making contact with an inner conductor, and the other dipole halves, which are interleaved in one another, making contact with the outer conductor.

The particular feature of this design principle is that, for example, the outermost dipole halves which are in the form of sleeves and are suitable for the higher frequency band range act as dipole radiating elements towards the outside, but act as a detuning sleeve towards the inside, so that those dipole halves which are in the form of sleeves and are provided for the low frequency band range cannot be identified for these radiating elements.

Those dipole halves which are in the form of sleeves, are provided for the lower frequency band range and, in contrast, are each designed to be longer act as radiating elements over their entire length outwards, without the blocking effect of the outer radiating element, which is in the form of a sleeve, having any effect for the higher frequency band range, but act as a detuning sleeve towards the inside, so that no surface waves can propagate onto the outer conductor.

If more than two frequencies or frequency bands are to be transmitted, the design principle can be extended appropriately, with the sleeves for the higher frequency each having a larger diameter in their shorter length extent, and the dipole halves, which are in the form of sleeves, for the lower frequency band range in each case being accommodated such that they are interleaved in one another.

This design principle also allows central feeding via a common connection or a common coaxial line, which is preferably used not only for feeding but is also used at the same time for mechanical robustness and holding the antenna. The coaxial vertical tube which is in the form of the outer conductor is in this case mechanically and electrically connected to the one dipole half at the appropriate feed point, that is to say at the short-circuiting point of this dipole half, with the inner conductor continuing slightly beyond the outer conductor, where it is electrically and mechanically attached to the short-circuiting points, which are similar to sleeve bases, of the other dipole halves. If the inner conductor has appropriate strength, there is no need for any further additional measures for robustness. Otherwise, additional measures which electrically have no effect but are used for robustness could be provided between the short-circuiting points, which are in the form of sleeves, of the mutually adjacent dipole halves. Apart from this, the entire antenna illustrated in the attached figure is accommodated in a protective tube, for example a tube composed of glass-fiber-reinforced plastic, which engages over the antenna arrangement, fitting it as accurately as possible, so that the inner conductor has to withstand and absorb only the weight of the upper dipole halves, since tilting loads and movements are absorbed by the protective tube.

It can also be seen from the figure that a further major advantage is that only a single coaxial cable connection is required for feeding the at least two or more frequency band ranges to the antenna device.

However, the dipole halves need not necessarily be in the form of tubular structures which are in the form of sleeves and are short-circuited at their feed points. These dipole halves, which are in the form of sleeves, may have circular or cylindrical cross sections, or may be provided with a polygonal or even oval cross section. They need not necessarily be in the form of closed tubes, either. Multi-element structures are also feasible, in which the dipole halves, which are similar to sleeves, are composed of a number of individual conductor sections or electrically conductive elements, or are broken down into these sections or elements, provided these sections or elements are short-circuited to one another at their respective feed end which is adjoined to the respective adjacent second dipole.

In particular, according to the invention, not only a single band but also a multi-frequency band antenna device is possible, which preferably comprises at least two antenna devices located one above the other, which can in turn transmit in at least two frequency band ranges each.

This can be achieved according to the invention in that the coaxial feed line arrangement is routed axially through that antenna device which is preferably in each case lower, and is continued to the next higher antenna device. In the feed line, the outer electrical conductors of the multiple coaxial feed lines are in each case used to feed the dipole halves of the lower antenna device while, in contrast, those conductors of the coaxial line (for example the inner conductor, which is generally in the form of a wire, and the innermost coaxial conductor surrounding it) which are inside the former are in each case used for electrically feeding that antenna device which is higher than the other and has the dipole halves provided there.

The design principle can be cascaded in a corresponding manner, so that three or more antenna devices can also be arranged one above the other.

This can preferably be achieved in a highly advantageous and effective manner by using a specific feed and output-coupling apparatus.

Figure 1B:
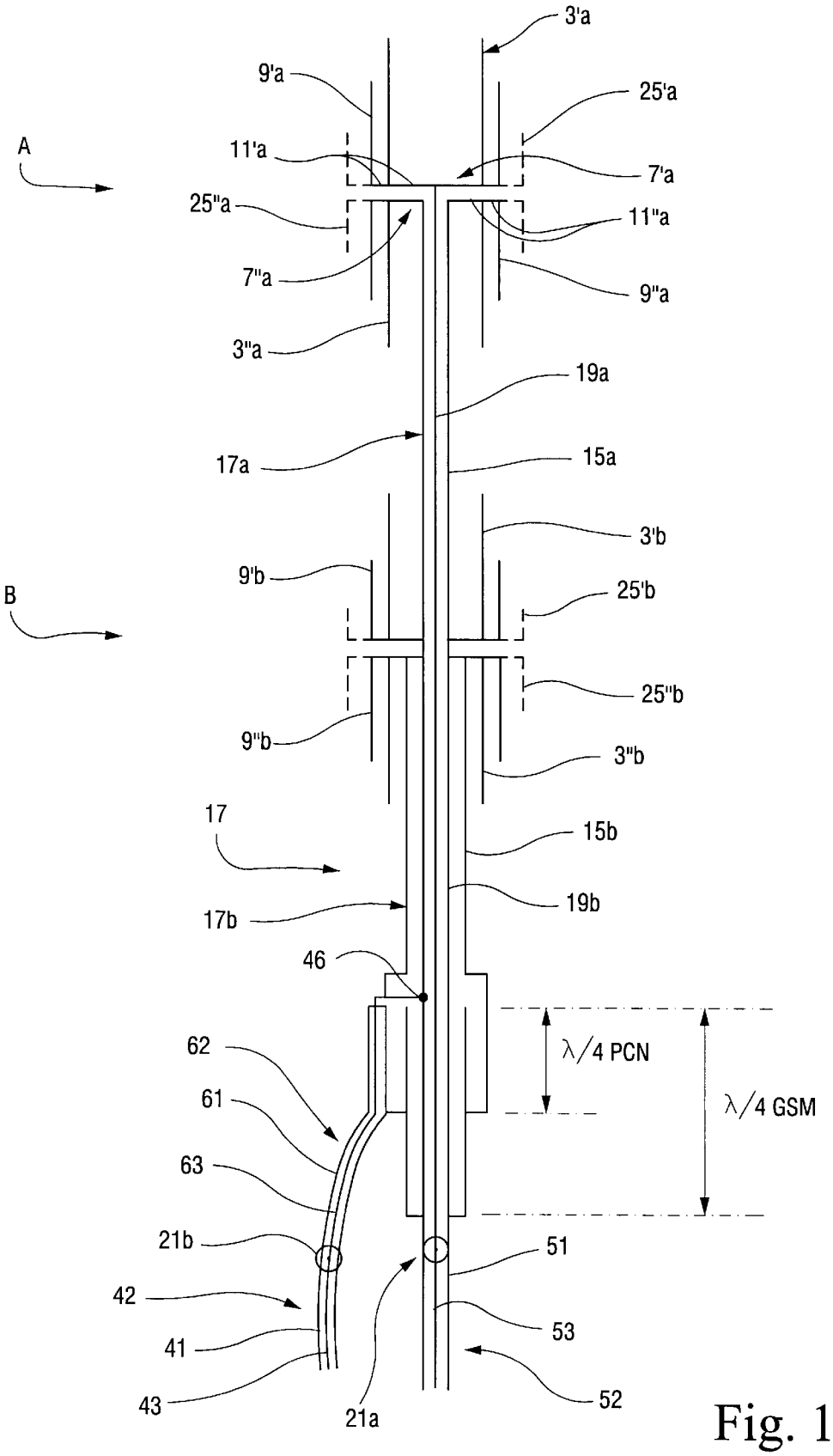
Figure 2:
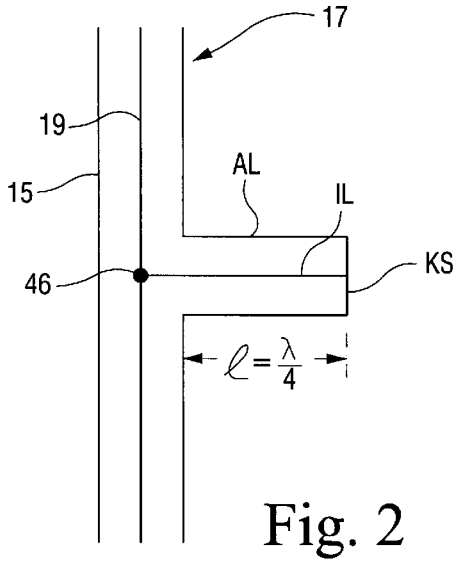
Figure 3:
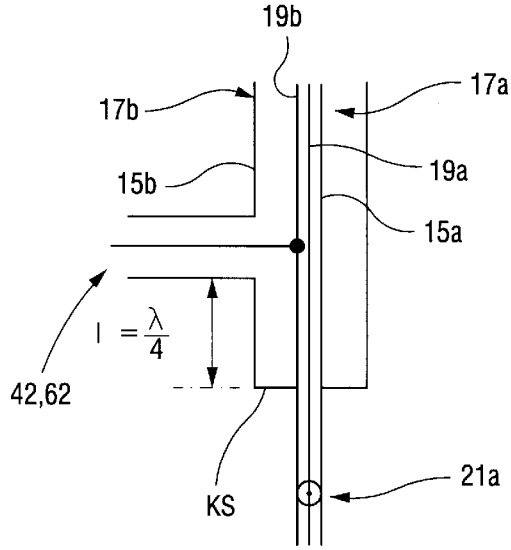
Figure 4:
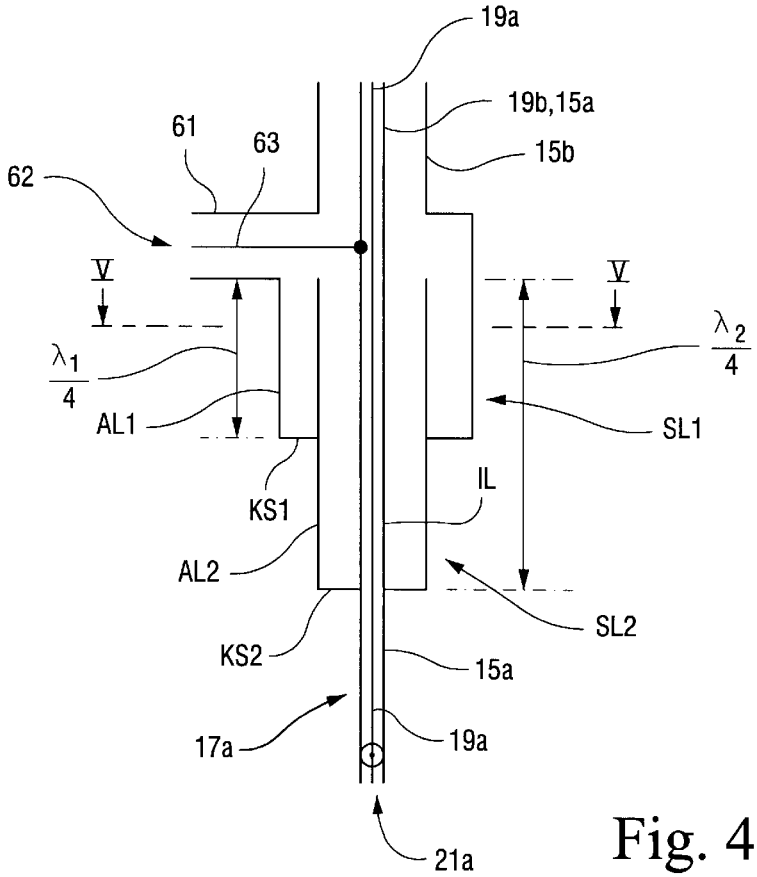
Figure 5:
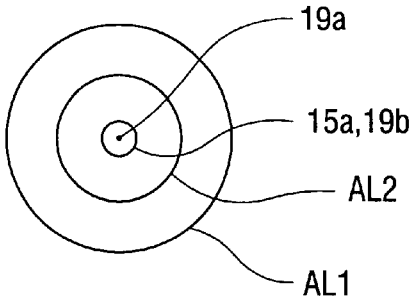
Figure 6:
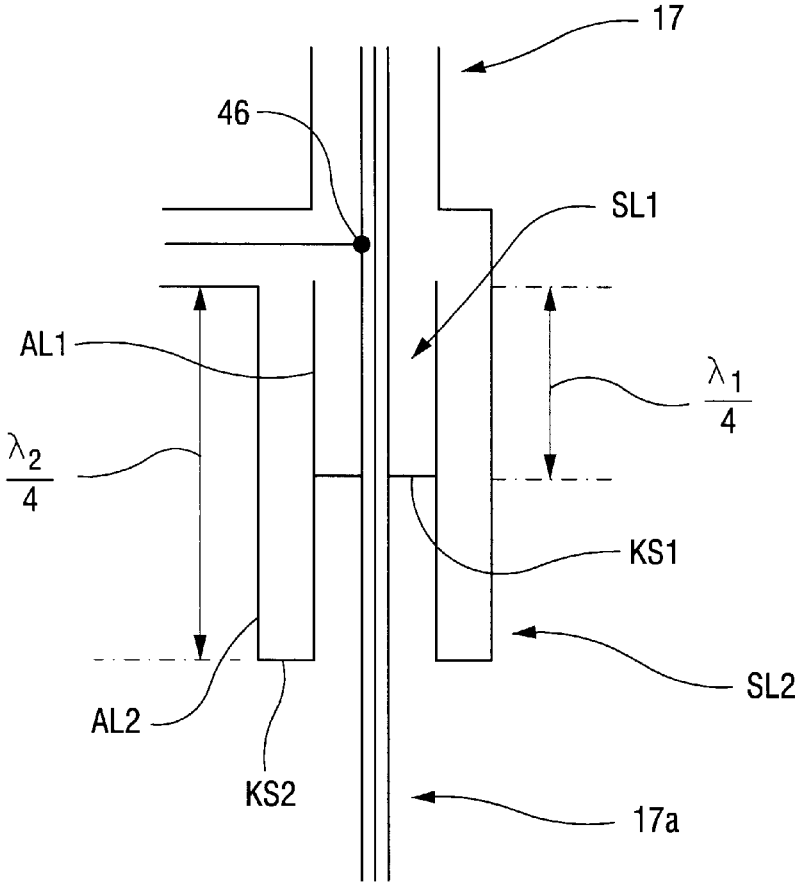
Figure 7:
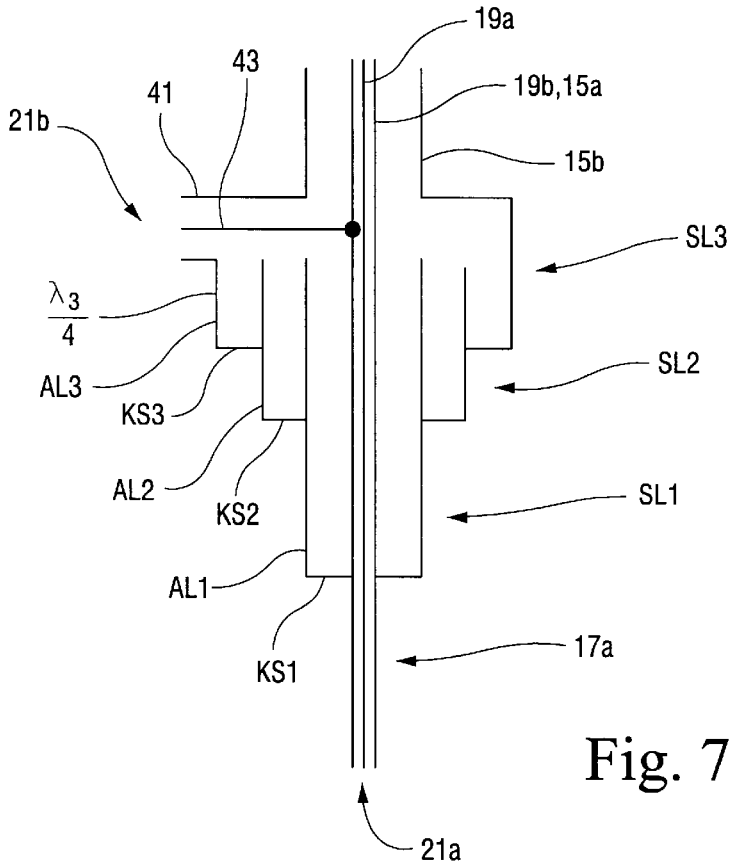
Figure 9:
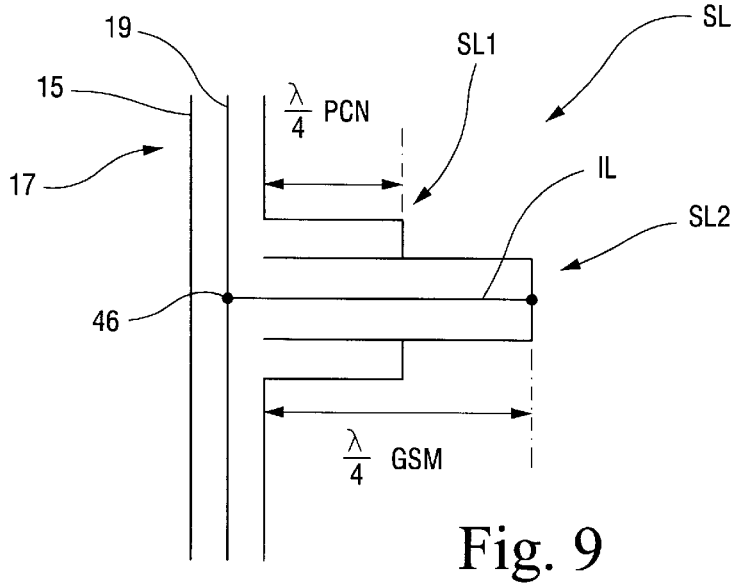
Figure 8:
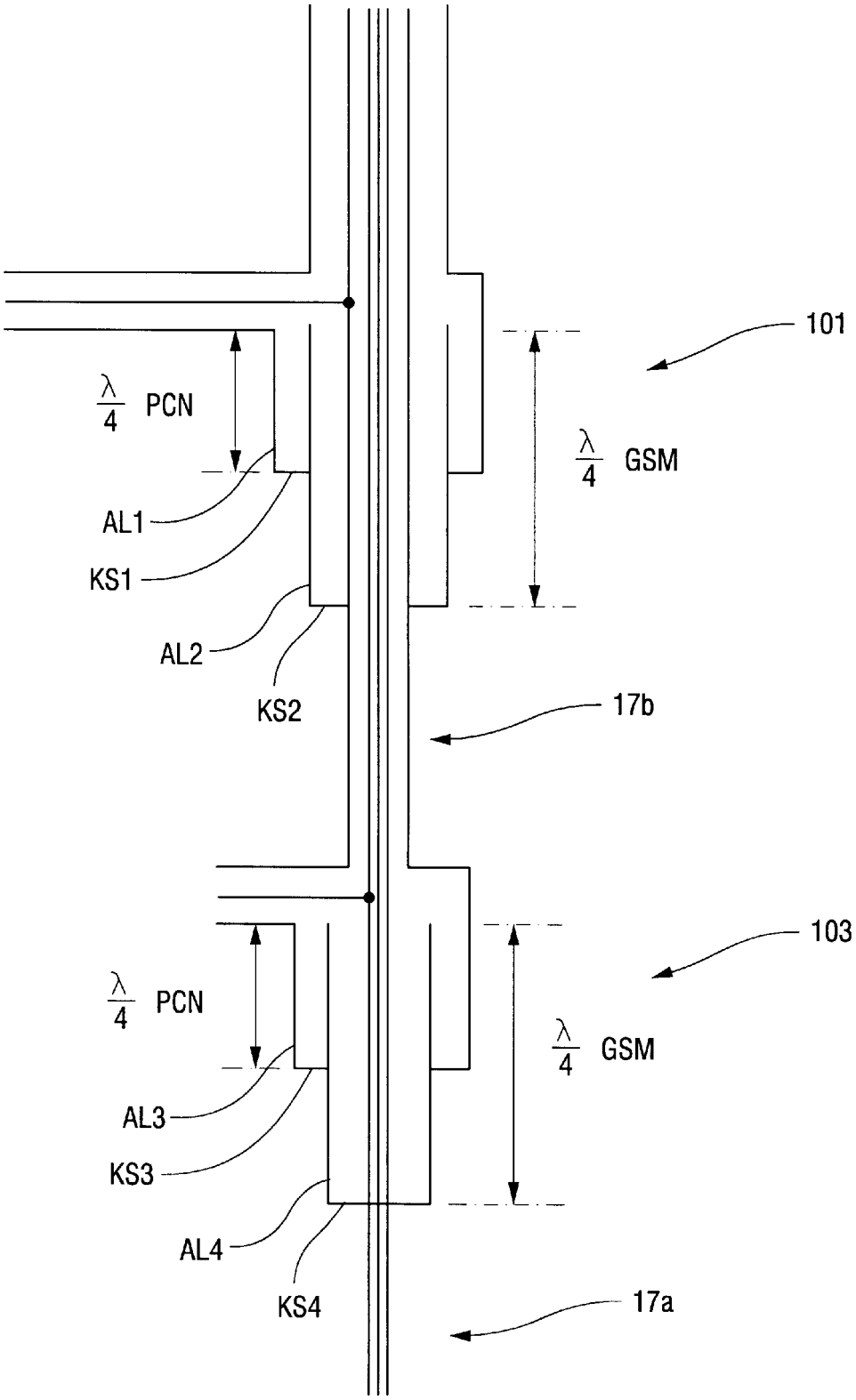

The invention will be explained in more detail in the following text with reference to exemplary embodiments. In the figures, in detail:

FIG. 1*a*: shows a schematic, axial longitudinal cross section of one exemplary embodiment of a two-band antenna (dipole structure);

FIG. 1*b*: shows a schematic axial longitudinal cross section through one exemplary embodiment of two two-band antennas arranged one above the other;

FIG. 2: shows a narrowband lightning protection device, which is known from the prior art, for a coaxial line;

FIG. 3: shows a detail of the schematic axial sectional illustration to explain the principle of a feed and output-coupling apparatus according to the invention for feeding a triax line for one frequency band;

FIG. 4: shows a development, according to the invention, of a multiband feed apparatus or output-coupling apparatus;

FIG. 5: shows a schematic cross-sectional illustration along the line V—V in FIG. 4;

FIG. 6: shows an exemplary embodiment modified from that in FIG. 4;

FIG. 7: shows an exemplary embodiment, once again modified from that in FIG. 4, of a multiband output-coupling apparatus for feeding three frequencies (three frequency bands), which are transmitted or received via two antenna devices;

FIG. 8: shows an exemplary embodiment, which is developed further with respect to that in FIG. 4, for feeding three antenna devices, which cover two frequency band ranges and are arranged one above the other, by means of a quadruple coaxial line; and FIG. 9: shows an embodiment, which is comparable to that in FIG. 4, but with only a single inner conductor (for example as lightning protection for a two frequency band device).

A multiband antenna 1 as shown in FIG. 1*a* comprises a first antenna 3 with two dipole halves 3' and 3" which, in the illustrated exemplary embodiment, are formed from an electrically conductive cylindrical tube. The dipole half 3' which is at the top in the figure is in this case in the form of a sleeve, that is to say it is closed in the form of a sleeve at its end 7' adjacent to the second dipole half 3'.

The length of these dipole halves 3' and 3" depends on the frequency band range to be transmitted and, in the illustrated exemplary embodiment, is matched to transmission of the lower GSM band range, that is to say, in accordance with the GSM mobile radio standard, to transmission in the 900 MHz band.

A second antenna in the form of a dipole is provided for transmitting a second frequency band range, in the illustrated exemplary embodiment this being 1800 MHz, and the dipole halves 9' and 9" of this antenna are designed with a shorter length, corresponding to the higher frequency band range to be transmitted, and, in the illustrated exemplary embodiment, are only about half as long as the dipole halves 3' and 3" since the transmission frequency is twice as high.

These dipole halves 9' and 9" are likewise in the form of tubes or cylinders in the illustrated exemplary embodiment, but have a larger diameter than the diameter of the dipole halves 3' and 3", so that the dipole halves of the antenna 9 which has the shorter length are accommodated within the dipole halves 3' and 3" having the greater longitudinal extent, and can engage over them.

The dipole halves 3' and 9', together with 3" and 9", are jointly designed in the form of sleeves, are each located such that they are interleaved in one another and are each located at the mutually adjacent inner ends 7' and 7" of the dipole halves, and are in this way electrically connected to one another, forming a short-circuit 11' or 11", respectively.

The drawing also shows that the lower dipole halves 3" and 9" are fed via an outer conductor 15 of a coaxial feed line 17, with the inner conductor 19 being routed beyond the short-circuit 11" at the end 7" of the lower dipole half as far as the short-circuiting connections 11', which are in the form of sleeves, of the upper dipole halves 3' and 9', where they are electrically and mechanically connected to the bases, which are in the form of sleeves, of these dipole halves 3' and 9'.

In this embodiment, it is possible to feed both dipole antennas 3 and 9, which are arranged such that they are interleaved in one another, via a single coaxial connection 21.

The antenna operates in such a way that those dipole halves which are provided for the higher frequency band range have a shorter longitudinal extent acting as radiating elements towards the outside, while the inside of these dipole halves 9' and 9", which are in the form of sleeves, act as a detuning sleeve. This detuning-sleeve effect ensures that no surface waves can propagate onto the dipole halves of the second antenna, which have a greater longitudinal extent.

However, the detuning sleeve for the higher frequency of the outer dipole halves 9', 9" which are in the form of tubes or sleeves "cannot be identified" or is effective for the second antenna 3 with the dipole halves 3', 3" which extend over a greater length, so that these dipole halves also act as individual radiating elements towards the outside. The inside of the lower dipole half 3", which is in the form of a sleeve, acts as a detuning sleeve, however. This detuning sleeve effect ensures that no surface waves can propagate on the outer conductor of a coaxial feed line.

This design results in an extremely compact antenna arrangement, which also has optimum omnidirectional radiation characteristic which has never been known in the past; and nevertheless has simplified feed via only a single, common connection.

However, in contrast to the illustrated exemplary embodiment, the dipole halves need not necessarily be in the form of tubes or sleeves. Instead of a round cross section for the dipole halves 3' to 9", polygonal (n-polygonal shaped) dipole halves, as well as other dipole halves whose shapes are not circular, for example being oval, are also feasible. Furthermore, structures for the dipole halves are also conceivable in which the circumferential outer surface is not necessarily closed, but is broken down into a number of individual elements which are curved in three dimensions or are even planar, provided these are electrically connected to one another at their mutually adjacent inner end 7' or 7", respectively, of the dipole halves at which the short-circuits 11' or 11", respectively, which are in the form of sleeves and have been mentioned above, are formed, and, at the same time, are designed such that the said blocking effect of the respective outer sleeve with respect to the inner sleeve is maintained, in order to ensure that no surface waves can propagate.

The dashed lines in the illustrated exemplary embodiment in the attached figure indicate that this design principle can be extended without any problems to other frequency band ranges. A dashed line in this case indicates that, for example, a further outer sleeve could also be provided for dipole halves 25' and 25" of a third antenna 25, which is designed for an even higher frequency and therefore has an even shorter longitudinal extent. These dipole halves 25' and 25" are also each short-circuited to the end of the other dipole half at their inner ends which point towards one another. The outside of these dipole halves 25' and 25" acts as a radiating element for this frequency, with the inside acting as detuning sleeves with respect to the next inner dipole halves. These detuning sleeves are, however, once again not effective for the dipole halves which are interleaved in one another.

In contrast to the exemplary embodiment shown in FIG. 1*a*, a dipole half which is not in the form of a sleeve or hollow cylinder, or the like, that is to say a dipole half in the form of a rod, for example, could also be used instead of the upper, innermost dipole half 3', since this dipole half does not need to accommodate either a further dipole half or a feedline connection in its interior.

A multiband antenna as shown in FIG. 1*b* comprises a first antenna device A whose design corresponds to that of the antenna device shown in FIG. 1*a*. The reference symbols used in FIG. 1*a* are just given the suffix letter "a" for the antenna device A in FIG. 1*b*.

The antenna device shown in FIG. 1*b,* however, also comprises a second multiband antenna device B, which is designed on the same principle, but for which the suffix letter "b" is used, rather than "a", for the first multiband antenna device A for the reference symbols for this second antenna device B.

In this embodiment, it is possible to feed both the dipole antennas 3*a* and 9*a,* which are arranged interleaved in one another, via a single coaxial connection 21*a,* at which a coaxial connecting line 52 is connected to an outer conductor 51 and an inner conductor 53, and the feed line 17, which starts from this point, and has the outer conductor 15*a* and the inner conductor 19*a*.

In an antenna such as that shown in FIG. 1*b,* it is thus desirable to have the capability to feed the upper multiband antenna device A, for example, via a triple coaxial line 17, that is to say via the inner coaxial line 17*a* with the inner conductor 19*a* and the outer conductor 15*a*, and to feed the lower antenna device B via the outer coaxial line 17*b* with the inner conductor 19*b* and the outer conductor 15*b*. In this case, the central coaxial conductor thus has two functions, firstly, it is the outer conductor 15*a* for the upper antenna device A and, at the same time, it is the inner conductor 19*b* for the lower antenna device B. Since, however, the outer conductor 15*a* of the inner coaxial line is connected to ground (for example by the coaxial connecting link 21*a* ), and this outer conductor 15*a* of the inner coaxial cable 17*a* at the same time represents the inner conductor 19*b* of the outer coaxial cable 17*b*, this means that the inner and outer conductors 19*b*, 15*b* of the outer coaxial cable 17*b* all have the same potential, namely ground.

Additional technical measures are therefore required which allow a corresponding feed for operation of the upper and lower antenna devices A and B, respectively, and which also allow an inner conductor to be connected to the potential of the outer conductor.

A solution which is known from the prior art for a coaxial line 17 with an inner conductor 19 and an outer conductor 15 is shown in FIG. 2, which has a coaxial spur line SL at a connecting point 46, the coaxial outer conductor AL of which spur line SL is electrically connected to the outer conductor 15, while its inner conductor IL is connected to the inner conductor 19 of the coaxial line 17. At the end of the spur line, the outer conductor AL is short-circuited to the associated inner conductor IL via a short-circuit KS in the form of a sleeve, by which means the inner conductor 19 is thus connected to the outer conductor 15 of the coaxial line 17. This is done, for a specific frequency or a specific frequency band, in such a manner that the electrical length of the coaxial spur line LS corresponds to $1=\lambda/4$, where $\lambda$ is the wavelength of the relevant frequency, or of the relevant frequency band. However, this is only ever possible in a narrowband form for a specific frequency, and thus for a specific wavelength.

Should the antenna described in FIG. 1 and having an upper and a lower antenna device be operated in only one frequency band, then this can be achieved via a common multiple coaxial line with a feed apparatus or output-coupling apparatus according to the invention, as shown in FIG. 3.

The exemplary embodiment shown in FIG. 3 differs from FIG. 2, inter alia, in that the coaxial line 17 makes a right-angle bend at the connecting point 46, that is to say coming from above, it is not routed downwards, as shown in FIG. 2, but, as it continues, bends away to the left at the connecting point 46. In the exemplary embodiment shown in FIG. 3, the spur line which is shown in FIG. 2 is shown lying in an axial extension of the coaxial connecting line which runs vertically upward above the connecting point 46. A further difference is that the inner conductor 19 shown in FIG. 2 is replaced by a coaxial line 17*a* in FIG. 3.

An electrical connection for the inner conductor 19*a* and for the outer conductor 15*a* of the inner coaxial line 17*a* for feeding the upper antenna device A can now be produced via a coaxial cable 52 which leads to a coaxial connection 21*a* and has an inner conductor 53 and an outer conductor 51, with the outer coaxial line 17*b* being fed appropriately via a second feed line 42 with an inner conductor 43 and an outer conductor 41, via a coaxial connection 21*b* and a coaxial intermediate line 62 with an inner conductor 63 and an outer conductor 61, for which purpose, finally, the inner conductor 63 of the second connecting line 42 is electrically connected to the inner conductor 19*b*, and the outer conductor 41 is connected to the outer conductor 15*b*, of the feed line 17*b*, at the connecting point 46. Thus, in the electrical sense, the intermediate line 62 represents the outer coaxial feed line 17*b* with the inner conductor 19*b* and the outer conductor

15*b*. If, as in this exemplary embodiment, the upper and lower antenna devices A and B, respectively, shown in FIG. 1 are operated in only one frequency band range, then they are fed at the connecting point 46 in such a way that the length 1 of the coaxial spur line SL and of the associated outer conductor AL corresponds to $1=\lambda/4$ at the frequency under discussion. An open circuit is transformed at the connecting point 46 [lacuna] by the short-circuit KS, which is in the form of a sleeve, as a result of which the outer outer conductor 15*b* is electrically short-circuited to the inner outer conductor 15*a*. The corresponding antenna device can thus be fed for operation in one frequency band using the feed and output-coupling apparatus explained with reference to FIG. 3.

However, in contrast, if the antenna described in FIG. 1 is intended to be operated with two antenna devices A and B, arranged one above the other, in two frequency band ranges, then a feed apparatus or output-coupling apparatus as explained in FIG. 4 is required, and this will be described in the following text.

For the antenna device, shown in FIG. 1, for operation of, for example, two different frequency band ranges, two coaxial $\lambda/4$ lines, which are each short-circuited via a respective short-circuit KS1 or KS2, are interleaved, with the outer $\lambda_1/4$ line SL1 being used for matching for the higher frequency (for example for transmission of the 1800 MHz frequency band range, for example PCN), and the inner $\lambda/4$ line SL2 being used for matching for the lower frequency, for example for the 900 MHz band (for example GSM). In consequence, the outer conductor AL1 of the first spur line SL1 is short-circuited at the end of the spur line (with respect to the feedpoint 46) by means of a radial short-circuit KS1, that is to say a short-circuit in the form of a ring or sleeve, to the outer conductor AL2 of the coaxial spur line SL2, and the outer conductor AL2 of the spur line SL2 is in turn short-circuited via a further radial short-circuit KS2, that is to say a short-circuit in the form of a ring or sleeve, to the inner conductor 19*b* of the outer coaxial line. The inner outer conductor AL2 ends freely, adjacent to the connecting point 46.

Thus, according to the exemplary embodiment, the upper antenna device A is fed via a first coaxial cable connection 21*a*, with the inner conductor 53 merging into the inner conductor 19*a* and the outer conductor 51 of the connecting line 52 merging into the outer conductor 15*a* of the coaxial feed line 17*a* for the upper antenna device A.

The lower antenna device B is fed via a second coaxial cable connection 21*b* and a downstream intermediate line 42 with an associated outer conductor 41 and an inner conductor 43, in such a way that the inner conductor 43 is electrically connected to the inner conductor 19*b* of the coaxial feed line 17, and the outer conductor 41 of the second coaxial cable connecting line is electrically connected to the outer conductor 15*b* of the triax line. In this case, the desired matching is carried out, as a function of the wavelength $\lambda_1/4$ and $\lambda_2/4$ with respect to the two frequency bands to be transmitted, at the lower end of the feed and output-coupling apparatus, by means of the spur lines SL1, SL2, which are interleaved in coaxial form and are each short-circuited at their end, with the first short-circuiting line KS1, which is in the form of a sleeve, being located approximately in the axial center with respect to the electrical length of the coaxial spur line SL2 and being matched to the frequency band ranges of 900 MHz and 1800 MHz, which are to be transmitted in this exemplary embodiment.

The two short-circuited $\lambda/4$ spur lines SL1 and SL2 which have been explained are thus connected in series such that the associated short-circuits KS1 and KS2 are each transformed to an open circuit at the connecting point 46 for the respective frequency band range.

FIG. 6 shows that the design principle of the series-connected short-circuiting lines KS1 and KS2 can also be implemented in the opposite sequence, namely if the $\lambda_2/4$ spur line SL2 (with the outer conductor AL2) for the lower frequency is arranged on the outside, and the $\lambda_1/4$ spur line SL1 (with the outer conductor AL1) for the higher frequency is arranged (concentrically) on the inside of the first spur line. However, the design complexity for this is somewhat greater.

In addition to the exemplary embodiments which have been explained above, a number of short-circuited $\lambda/4$ lines, for example three such lines, can also be interleaved in one another, thus feeding or providing output coupling for a number of frequency band ranges (for example three frequency bands).

FIG. 7 will be used only to explain the design principle for the situation in which it is intended to feed three frequency bands, which are offset with respect to one another, into a corresponding multiple coaxial feed line 17, for which purpose a third short-circuiting connection KS3 is provided for matching, with the assumption being made in this exemplary embodiment that the third short-circuit KS3 has a length $\lambda_3/4$ for the transmission of an even higher frequency band range.

An exemplary embodiment which is once again modified with respect to that shown in FIG. 4 for a feed apparatus or output-coupling apparatus is illustrated in FIG. 8, in which apparatus, for example, in addition to the exemplary embodiment shown in FIG. 1, three antenna devices which are arranged one above the other can be fed jointly via one multiple coaxial cable line 17, with these antenna devices operating in two frequency band ranges. This is done in cascade form via two feed and output-coupling apparatuses, as explained with reference to FIG. 4, each with appropriate matching between an outer outer conductor and an associated inner conductor which at the same time represents the outer conductor for the next inner inner conductor. In each of the envisaged stages, an outer conductor is connected by its associated inner conductor to a common potential in each case via the described feed apparatus or output-coupling apparatus 101 or 103, respectively, according to the invention. The exemplary embodiment in FIG. 8 shows how this method can also be extended to a number of stages by further outer conductors AL1, AL2 and short-circuits KS3, KS4.

FIG. 9 shows another feed and output-coupling apparatus for a single coaxial line 17, but provided with broadband lightning protection, in the illustrated exemplary embodiment for two frequency band ranges.

The function in this case corresponds to the exemplary embodiment shown in FIG. 4, with the difference being that only a single inner conductor 15 is provided instead of the inner coaxial conductor 17*a* shown in FIG. 4, so that this inner conductor is passed through so that it runs without any curvature in the axial direction, and the two interleaved spur lines SL1 and SL2, which are once again short-circuited at the end, branch off at right angles from this coaxial line 17. With regard to the design and method of operation, reference is otherwise made to the exemplary embodiment shown in FIG. 4 which, with regard to the outer coaxial conductor 17*b* illustrated in FIG. 4 and the outer conductor 15*b* and inner conductor 19*b*, can be transferred analogously to the exemplary embodiment shown in FIG. 9.

What is claimed is:

1. A multiband antenna arrangement comprising:

a feed line arrangement, at least a first antenna having a first operating frequency range, said first antenna including an inner dipole half that faces the feed line arrangement and an outer dipole half that faces away from the feed line arrangement, at least a second antenna having a second operating frequency range higher than the first frequency range, said second antenna including an inner dipole half that faces the feed line arrangement and an outer dipole half that faces away from the feed line arrangement, wherein:

the first antenna and the second antenna are integrated and interleaved with one another, with the first antenna dipole halves being disposed at least partially within the second antenna dipole halves, the dipole halves are at least electrically in the form of sleeves or boxes, the dipole halves have respective mutually adjacent inner ends that are short-circuited to one another, and the dipole halves extend from said inner ends with lengths that are dependent on said operating frequency ranges.

2. The multiband antenna of claim 1, wherein the dipole halves are arranged coaxially with respect to one another.

3. The multiband antenna of claim 1, wherein the dipole halves are circular.

4. The multiband antenna of claim 1, wherein the dipole halves are polygonal.

5. The multiband antenna of claim 1, wherein the dipole halves are polygonal with n sides.

6. The multiband antenna of claim 1, wherein the dipole halves are oval in the cross section transverse with respect to the longitudinal extent thereof.

7. The multiband antenna of claim 1, further including an electrically conductive dipole wall for short-circuiting the dipole halves, the wall being closed in a circumferential direction transversely with respect to the longitudinal extent of said dipole halves.

8. The multiband antenna of claim 1, further including an electrically conductive dipole wall provided in the circumferential direction transversely with respect to the longitudinal extent of the dipole halves, said wall being broken down into a number of individual elements which are electrically short-circuited to one another at respective inner ends a corresponding dipole halves.

9. The multiband antenna of claim 1, wherein the feed line arrangement has a common connection that feeds the first and second antennas.

10. The multiband antenna of claim 1, wherein the feed line arrangement has a common coaxial line that feeds the first and second antennas.

11. The multiband antenna according to claim 10, wherein the coaxial line provides a mechanical support and holder for the multiband antenna, the coaxial line comprising a vertical tube.

12. The multiband antenna according to claim 10, wherein the coaxial line includes an outer conductor that feeds, mechanically supports and holds said dipole halves.

13. The multiband antenna of claim 1, wherein the feed line arrangement includes an inner conductor and an outer conductor, the inner conductor projecting at least slightly beyond the outer conductor, the inner conductor feeding plural dipole halves, said inner conductor including a projecting end that mechanically holds and supports said plural dipole halves.

14. The multiband antenna of claim 1 further including at least a third antenna integrated therein.

15. The multiband antenna of claim 14 wherein the third antenna comprises dipole halves comprising sleeves.

16. The multiband antenna of claim 14 wherein the third antenna has an innermost enclosure portion, and the feed line arrangement passes axially through the third antenna within the innermost enclosure portion thereof to extend to the first and second antennas.

17. The multiband antenna of claim 14 wherein the feed line arrangement comprises a multiple coaxial line having an outer coaxial conductor and an inner conductor, the third antenna having at least one dipole half in proximity to the feed line arrangement, the outer coaxial conductor being connected to a third antenna dipole half in proximity to the feed line, the inner conductor being connected to at least one further third antenna dipole half, the inner conductor providing an outer coaxial conductor for a further inner conductor, said further inner conductor feeding at least one of the first and second antennas.

18. The multiband antenna of claim 17 wherein the inner conductor extends from the third antenna and is connected to a said dipole half of the first antenna and a said dipole half of the second antenna.

19. The multiband antenna according to claim 17 wherein the feed line arrangement comprises at least one triax line having an outer coaxial line and an inner coaxial line, the outer coaxial line having an inner conductor that forms an outer coaxial conductor for the inner coaxial line.

20. The multiband antenna according to claim 14, wherein the feed line arrangement comprises a multiple coaxial feed line having 2 n lines which are electrically isolated from one another.

21. The multiband antenna according to claim 14 wherein the feed line arrangement comprises:

a multiple coaxial feed line having an outer conductor and an inner conductor, a spur line branching off from the coaxial feed line, the spur line comprising at least inner and outer interleaved coaxial spur lines, the outer coaxial spur line having an electrical length corresponding to $\lambda_1/4$, where $\lambda_1$ corresponds to, or is matched to, the wavelength of the first frequency range, the inner coaxial spur line having an electrical length corresponding to $\lambda_2/4$, where 2 corresponds to, or is matched to, the wavelength of the second frequency range, the outer coaxial spur line having an outer conductor with an end, the inner coaxial spur line having an outer conductor with an end and also having an inner conductor, said outer coaxial spur line outer conductor end being short-circuited via a first short-circuit connection to the inner coaxial spur line outer conductor, the inner coaxial spur line outer conductor end being connected via a second short-circuit connection to the inner coaxial spur line inner conductor, the outer coaxial spur line outer conductor being connected to the coaxial feed line outer conductor, the inner coaxial spur line inner conductor being electrically connected at a connecting point to the feed line inner conductor, and the feed line arrangement being matched for at least the two operating frequency ranges.

22. The multiband antenna according to claim 21, wherein the inner and outer spur lines run transversely away from the coaxial feed line, and the antenna further includes a connecting point for routing the inner and outer spur lines.

23. The multiband antenna according to claim 22 wherein the inner and outer spur lines run transversely in an axial extension beyond the connecting point.

24. The multiband antenna according to claim 21, wherein the feed line arrangement comprises at least one triax line, and the inner spur line inner conductor comprises a coaxial feed which passes through the second short-circuit connection.

25. The multiband antenna according to claim 21, wherein the outer coaxial spur line outer conductor is electrically connected to the outer coaxial feed line outer conductor, and the inner spur line inner conductor forms the inner feed line outer conductor and is electrically connected at a connecting point to the outer feed line inner conductor.

26. The multiband antenna according to claim 21, wherein the first and second short-circuit connections comprise rings.

27. The multiband antenna according to claim 21, wherein the first and second short-circuit connections comprise sleeves.

28. The multiband antenna according to claim 21, wherein the electrical length of said first and second interleaved spur lines are dimensions in dependence on the first and second operating frequency ranges so as to electrically transform said short-circuit connections to electrical open circuit connections.

29. The multiband antenna according to claim 21, wherein the first short-circuit connection has a greater axial length than the second short-circuit connection.

30. The multiband antenna of claim 29 wherein the first short-circuit connection is located outside, and coaxially surrounds the second short-circuit connection.

31. The multiband antenna of claim 29 wherein the first short-circuit connection is located inside, and is coaxially surrounded bt the second short-circuit connection.

32. The multiband antenna according to claim 21, wherein the first and second short-circuit connections comprise sleeves that run radially with respect to, and are offset in the longitudinal direction of, the multiple coaxial feed line.

33. The multiband antenna of claim 1, wherein the feed line arrangement comprises an inner feed line, a connecting point, and an outer feed line having an inner conductor connected to the connecting point, the inner feed line running in a straight direction via the connecting point.

34. The multiband antenna of claim 1, wherein the feed line arrangement comprises:

a multiple coaxial line including at least one inner coaxial line having an inner conductor and an outer conductor, and at least one further axial outer conductor surrounding the inner coaxial line and having a connecting point defined thereon, and a second coaxial connecting line having an inner conductor, wherein said further axial outer conductor has an outlet opening, the second coaxial connecting line inner conductor being routed through said outlet opening to said connecting point.

35. The multiband antenna of claim 1, wherein the feed-line arrangement comprises a multiple coaxial line having at least one inner conductor, at least one outer conductor, and a connection that connects said at least one inner conductor and said at least one outer conductor to the same potential.

36. The multiband antenna of claim 35 wherein said potential comprises ground potential .

37. The multiband antenna according to claim 35, wherein said connection comprises a broadband connection.

38. The multiband antenna according to claim 35, wherein said connection couples at least said two operating frequency ranges.

39. The multiband antenna of claim 35 wherein the feed line arrangement is match ed over a broadband for at least the first and second frequency ranges.

40. An antennas structure for use with a first frequency range and a second frequency band lower than said first frequency range, said antenna structure comprising:

a first antenna for use at the first frequency range, said first antenna including first and second dipole halves comprising sleeves, a second antenna for use at the second frequency range, said second antenna comprising first and second dipole halves comprising sleeves, the first and second antennas being arranged such that they are integrated and interleaved in one another, said second antenna dipole halves being disposed within said first antenna dipole halves, at least some of the dipole halves being short-circuited at their respective mutually adjacent inner ends and extending therefrom with lengths dependent on the first and second frequency bands, respectively.

41. The antenna structure of claim 40 wherein said frequency ranges are in different frequency bands.

* * * * *